United States Patent [19]

Ivankovich

[11] 4,258,654

[45] Mar. 31, 1981

[54] BASEBOARD PAINT GUARD

[76] Inventor: Robert F. Ivankovich, 262 First Ave. N., Welland, Ontario, Canada

[21] Appl. No.: 953,729

[22] Filed: Oct. 23, 1978

[51] Int. Cl.[3] ..... B05C 21/00

[52] U.S. Cl. ..... 118/504

[58] Field of Search ..... 118/504, 301, 406, 505

[56] References Cited

U.S. PATENT DOCUMENTS

| | | | |
|---|---|---|---|
| 2,290,472 | 7/1942 | Hendrick | 118/301 |
| 2,453,863 | 11/1948 | Salisbury | 118/504 |
| 2,698,003 | 12/1954 | Bullock | 118/504 |
| 3,039,433 | 6/1962 | Kormuth | 118/505 |
| 3,048,146 | 8/1962 | Coppola | 118/504 |
| 3,422,798 | 1/1969 | Pine | 118/504 |
| 3,429,296 | 2/1969 | Legere | 118/504 |
| 3,741,154 | 6/1973 | Szczepanski | 118/504 |

*Primary Examiner*—John P. McIntosh

*Attorney, Agent, or Firm*—Beveridge, DeGrandi, Kline & Lunsford

[57] ABSTRACT

A guard for protecting a baseboard from paint during the painting of a wall surface has a generally horizontal shield supported by stands whose height is selectively adjustable. All elements of the mechanism for vertical adjustment of the height of the shield are disposed such that, in use, they are fully covered by the shield to avoid contamination of the mutually moveable parts by paint, to thus secure a lasting convenient adjusting the height of the guard, as opposed to cumbersome handling that is often encountered in prior art due to the dried paint preventing smooth movement of the parts of the adjustment mechanism.

2 Claims, 4 Drawing Figures

BASEBOARD PAINT GUARD

The present invention relates to a baseboard paint guard, more particularly, to a baseboard paint guard which is suited to baseboards of different heights.

A baseboard is susceptible to paint contamination when a wall surface above the baseboard is painted. A paint roller is normally used to paint a wall surface and the paint usually drips or sputters down onto the baseboard thereby contaminating it as the baseboard is normally painted in a colour different from that of the respective wall surface. Various types of baseboard paint guards have been proposed.

U.S. Pat. No. 2,290,472 issued July 21, 1942, to J. V. Hendrick, discloses a baseboard guard including a plate of a generally L-shaped cross-sectional configuration adapted for securement to the baseboard by suction cups such that the shorter arm covers the top edge of the baseboard. Then, a flat shield is placed under the longer arm to cover the lower part of the baseboard. The baseboard paint guard of the Hendrick patent may be applied to baseboards of different heights by varying the size of the flat shield. The use of this type of guard is cumbersome as the baseboard must have a relatively smooth surface to allow the suction cups to function. Most of baseboards have a relatively uneven surface to which the cup of Hendrick simply cannot be attached. Moreover, the suction cups may cause damage to the baseboard surface.

U.S. Pat. No. 3,422,798, issued Jan. 21, 1969, to D. A. Pine, discloses a baseboard paint guard which is designed to lean against the wall. It cannot abut perpendicularly against the wall. Accordingly, if one has to paint a wall down to the baseboard, it is necessary to remove the guard to finish the wall. A similar baseboard paint guard is disclosed in U.S. Pat. No. 3,429,296, issued Feb. 25, 1969, to R. E. Legere. U.S. Pat. No. 3,565,038, issued Feb. 23, 1971 to John D. Van Barriger, discloses a baseboard paint guard consisting of an elongated panel. For application, one of the longitudinal edges of the panel is placed to lean against the top edge of a baseboard. If the baseboard is relatively high, the guard cannot reach the top edge of the baseboard.

U.S. Pat. No. 2,698,003, issued Dec. 28, 1954 to F. A. Bullock, shows an adjustable baseboard paint guard. The guard comprises a shield strip, a flange extending downwardly from one side edge of the shield strip and defining longitudinally spaced openings therethrough, posts, "U" bolts and wing-nuts. In use, the other side edge of the shield strip is placed on the top edge of a baseboard and the flange is fastened to the posts by using the "U" bolts and the wing-nuts. The height of the shield strip is thus adjustable to fit the height of a baseboard. The top shield is designed to slightly slope toward the wall and is therefore disadvantageous as paint dripped or sputtered onto the shield strip may run down toward the wall and may flow onto the baseboard through the gap between the shield strip and the wall. An even more serious drawback is that the posts are arranged outside the shield strip. Therefore, the posts and "U" bolts are exposed to the dripping paint which may eventually result in considerable hampering of the adjusting operation as the paint prevents smooth sliding of the U-bolt along the post. Accordingly, fine adjustment of the height of the shield is very difficult with the result that the worker may tend to set the shield higher than necessary and to let the device lean against the wall at an angle of inclination even greater than that shown in the drawings of the reference.

It is an object of the present invention to provide a baseboard paint guard which solves the disadvantages of the prior art, which is simple in application and is relatively inexpensive to manufacture.

In accordance with the present invention, a baseboard paint guard is provided for protecting a baseboard from paint during the painting of a wall surface above the baseboard, said paint guard comprising, in combination, as shield secured to stand means, said stand means being of the type adapted to support the shield at a spacing from a generally horizontal surface such as a floor, said stand means including adjustment means for selectively adjusting the magnitude of said spacing, wherein all components forming said adjustment means are arranged to be disposed entirely within a shielded space limited by said shield, by said generally horizontal surface and, on sides, by a projection of the contour of said shield as viewed in plan, when the guard is in operable position.

In a particularly preferred embodiment, the stand means includes a base plate which is also disposed entirely within said shielded space, whereby said shielded space encompasses the entire stand means.

The baseboard guard according to this invention is thus not only applicable to baseboards of different heights by adjusting the height of the shield; since all components of the shield height adjusting means are disposed within the plan area covered by the shield, the components are all protected from paint contamination.

If the length of the baseboard to be covered is in excess of the length of the guard, a number of guards can be used in overlapping fashion which can be readily achieved as the protection of the components results in a generally permanently smooth relative movement of the height adjustment mechanism, thus facilitating fine adjustment of the height for the overlapping.

Other aspects and advantages of this invention will become apparent from the following more detailed description referring to the accompanying drawing, in which.

Figure 2:
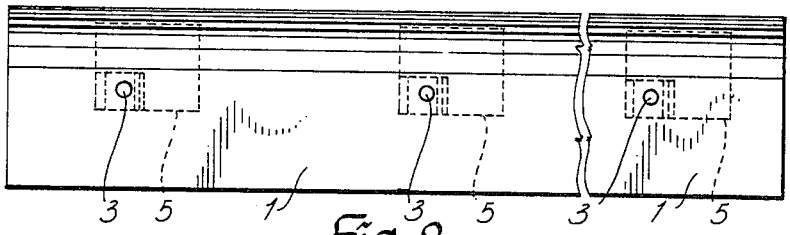
FIG. 2 is a top plan view of the baseboard paint guard shown in FIG. 1.

A shield strip 1 is provided with three equidistantly elongated upright members 2, each of which is of an inverted L-shaped configuration. The upright members 2, are fixedly secured to the shield strip 1 by means of rivets 3. Each upright member is provided with a bolt 4 which extends through the respective upright member at a point adjacent the lower free end thereof. The head portion of the bolt 4 is braced to the respective upright member 2. Accordingly, each bolt 4 is fixedly secured to the respective upright member.

Each bolt 4 passes through a slot 8 extending longitudinally of a respective leg 6 formed by an L-shaped strip whose lower, short arm is fixedly secured to a base plate 5 by a screw 7. Wing nut 11 is mounted on the free end of the respective bolt 4.

Figure 4:
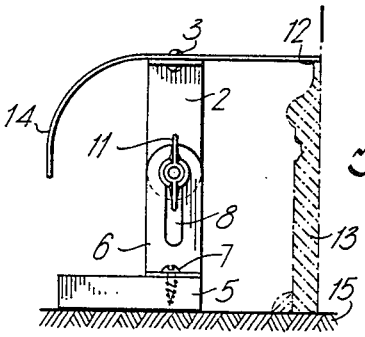
FIG. 4 is an end elevational view of the baseboard paint guard shown in FIGS. 1 through 3.
Figure 1:
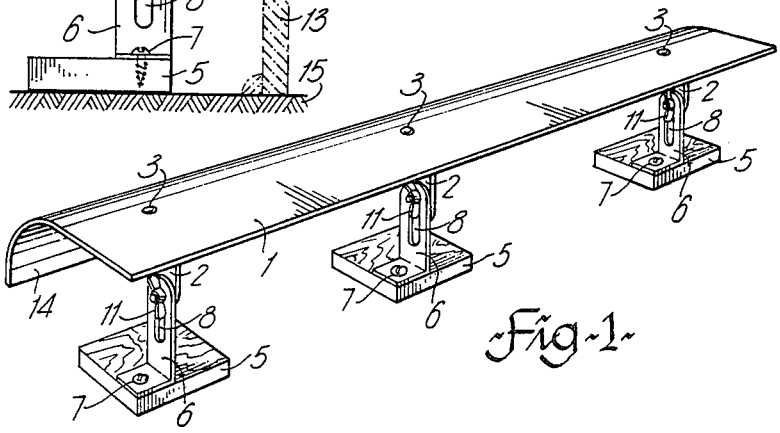
FIG. 1 is a perspective view of the baseboard paint guard according to one embodiment of the present invention.

It will thus be appreciated that each upright member 2 is slideable relative to the associated leg 6 and can be secured to same at a predetermined position by tightening the respective nut 11. In general terms, therefore, the respective upright member 2, bolt 4, nut 11, leg 6 and the slot 8 form a mechanism that can also be referred to as "adjustment means for selectively adjusting the magnitude of the spacing of the shield 1 from the floor 15", as best seen in FIG. 4 wherein the shield 1 is shown as being at its maximum height. The combination of the above preferred embodiment of the adjustment mechanism with the respective base plate 5 can also be referred to as forming "stand means" to which the shield is secured.

Referring particularly to the representation of FIG. 2, it will be seen that the shield 1 of the embodiment shown defines a generally rectangular area. If that area is vertically projected to the floor 15 on which the guard normally rests (FIG. 4), then one can readily appreciate from FIG. 2 that all components of the above mentioned "adjustment means" are disposed within the space limited by the shield 1, by the floor 15 and, sidewise by an imaginary projection of the contour of shield 1 in a direction perpendicular to the plane of FIG. 2. As a matter of fact, FIG. 2 shows the particularly preferred embodiment in which even the base plates 5 are within the confines of the space, so that the entire stand means is completely covered by the shield, when in use.

As shown in FIG. 4, the height of the shield strip 1 is adjusted so as to place a longitudinal edge 12 of the shield strip 1 on the top edge of a baseboard 13. In order to prevent paint from running down between the longitudinal edge 12 of the shield strip 1 and the wall, the edge 12 is normally abutted against the wall. The other longitudinal edge 14 of the shield strip 1 is bent downwardly to allow paint to drip thereover.

Figure 3:
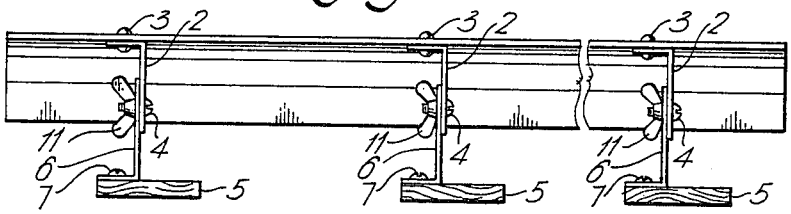
FIG. 3 is a side elevational view of the baseboard paint guard shown in FIGS. 1 and 2.

For a baseboard which is lower than shown in FIG. 3, the nuts 11 are loosened to allow the bolts 4 to slide down in the slots 8 until the longitudinal edge 12 of the shield strip contacts the top edge of the lower baseboard. Thereafter, the nuts 11 are tightened.

Those skilled in the art will readily conceive many modifications of the above preferred embodiment. For instance, one can readily appreciate that if the stand means is turned by 90° about a vertical axis, the guard can be used in a slanted position, for instance, in protecting baseboards extending along the stairs. The actual mechanism of the height adjustment can be of many other different kinds. The base plate 5 can be replaced by an extension of the lower arm of the respective legs, i.e. totally omitted.

However, the above and many other modifications of the preferred embodiment as described above do not depart from the scope of the present invention as set forth in the accompanying claims.

The embodiments of the invention in which an exclusive property or privilege is claimed are defined as follows:

1. A baseboard paint guard for protecting a baseboard from paint during the painting of a wall surface above the baseboard, said paint guard comprising, in combination a normally horizontal shield made of a relatively thin sheet-like material secured to stand means and having a generally straight, relatively thin longitudinal edge portion whose thickness corresponds to the thickness of said sheet-like material, said stand means being of the type adapted to stand on a generally horizontal surface such as floor, and to support the shield at a vertical spacing from said horizontal surface, said stand means including adjustment means for selectively adjusting the magnitude of said spacing while maintaining a generally horizontal position of said shield, wherein all components forming said adjustment means are arranged to be disposed entirely within a shielded space limited by said shield, by said generally horizontal surface, and, on sides, by a generally vertical projection of the contour of said shield as viewed in plan, when the guard is in operable position.

2. A baseboard paint guard as claimed in claim 1, wherein said stand means includes a base-plate which is also disposed entirely within said shielded space, whereby said shielded space encompasses the entire stand means.

* * * * *